US009947436B2

(12) United States Patent
Sakurai et al.

(10) Patent No.: US 9,947,436 B2
(45) Date of Patent: Apr. 17, 2018

(54) INSULATED ELECTRIC WIRE AND METHOD FOR MANUFACTURING SAME

(71) Applicants: MITSUBISHI MATERIALS CORPORATION, Tokyo (JP); Mitsubishi Cable Industries, Ltd., Tokyo (JP)

(72) Inventors: Hideaki Sakurai, Naka-gun (JP); Kenji Kawamura, Amagasaki (JP); Tsuyoshi Takubo, Amagasaki (JP)

(73) Assignees: MITSUBISHI MATERIALS CORPORATION, Tokyo (JP); MITSUBISHI CABLE INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/522,298

(22) PCT Filed: Oct. 29, 2015

(86) PCT No.: PCT/JP2015/080550
§ 371 (c)(1),
(2) Date: Apr. 27, 2017

(87) PCT Pub. No.: WO2016/068234
PCT Pub. Date: May 6, 2016

(65) Prior Publication Data

US 2017/0316848 A1 Nov. 2, 2017

(30) Foreign Application Priority Data

Oct. 31, 2014 (JP) ..... 2014-223761

(51) Int. Cl.
*H01B 3/30* (2006.01)
*H01B 3/44* (2006.01)
(Continued)

(52) U.S. Cl.
CPC ..... *H01B 7/02* (2013.01); *H01B 1/026* (2013.01); *H01B 7/0009* (2013.01); *H01B 13/0036* (2013.01)

(58) Field of Classification Search
CPC ..... C22C 21/00; H01B 1/026; H01B 5/02; H01B 7/00; H01B 7/02; H01B 7/42;
(Continued)

(56) References Cited

U.S. PATENT DOCUMENTS 5,449,861 A * 9/1995 Fujino ..... H01B 13/0006 174/113 A
2003/0132023 A1* 7/2003 Morita ..... H01B 12/02 174/126.2
(Continued)

FOREIGN PATENT DOCUMENTS

JP 2003-317547 A 11/2003
JP 2008-147062 A 6/2008
(Continued)

OTHER PUBLICATIONS

International Search Report dated Jan. 19, 2016, issued for PCT/JP2015/080550 and English translation thereof.

*Primary Examiner* — Timothy Thompson
*Assistant Examiner* — Guillermo Egoavil
(74) *Attorney, Agent, or Firm* — Locke Lord LLP

(57) ABSTRACT

An insulated electric wire and a method of producing the electric wire are provided. The insulated electric wire includes: a copper wire; and an insulating coating formed on a surface of the copper wire by an electrodeposition method. A cross section shape of the insulated electric wire including the insulating coating is in a hexagonal shape, a chamfered part that suppresses swelling of the insulating coating is formed on each corner part of a hexagonal cross section of the copper wire, a length of the chamfered part is ⅓ to 1/20
(Continued)

of a length of a flat part of the hexagonal cross section, and a void ratio in a wound state is 5% or less.

6 Claims, 3 Drawing Sheets

(51) Int. Cl.

| | |
|---|---|
| ***H01B 7/295*** | (2006.01) |
| ***H01B 7/02*** | (2006.01) |
| ***H01B 1/02*** | (2006.01) |
| ***H01B 7/00*** | (2006.01) |
| ***H01B 13/00*** | (2006.01) |

(58) Field of Classification Search
CPC ..... H01B 7/0009; H01B 13/00; H01B 13/16; H01B 13/0036; H01F 5/00; H01F 5/06; H01F 27/28
USPC ..... 174/110 R
See application file for complete search history.

(56) References Cited

U.S. PATENT DOCUMENTS

| | | | | |
|---|---|---|---|---|
| 2012/0267141 | A1* | 10/2012 | Kamiyama | B21C 37/047 174/102 R |
| 2015/0348679 | A1* | 12/2015 | Takeuchi | H01L 39/12 505/510 |
| 2015/0371733 | A1* | 12/2015 | Cantz | H01B 7/0009 174/23 R |
| 2017/0106421 | A1* | 4/2017 | Gleich | B21C 37/047 |
| 2017/0309375 | A1* | 10/2017 | Aimone | H01B 12/10 |

FOREIGN PATENT DOCUMENTS

| | | | |
|---|---|---|---|
| JP | 2009-026699 | A | 2/2009 |
| JP | 2009-134891 | A | 6/2009 |
| JP | 2014-032751 | A | 2/2014 |

* cited by examiner

INSULATED ELECTRIC WIRE AND METHOD FOR MANUFACTURING SAME

TECHNICAL FIELD

The present invention relates to an insulated electric wire on which an insulating coating is formed by the electrodeposition method. In the electric wire, there is high degree of freedom in winding direction and the void ratio in the wound state is extremely low in the case where the insulated electric wire is used for a magnet coil or the like.

Priority is claimed on Japanese Patent Application No. 2014-223761, filed Oct. 31, 2014, the content of which is incorporated herein by reference.

BACKGROUND ART

Conventionally, as the wire material for coil such as motors and the like, the round wire, in which an insulating coating is provided on the core wire (copper wire) having a cross-sectional shape in a round shape, is used. However, there is a problem that: voids are formed between adjacent round wires; and the void ratio becomes high, when the round wire is wound in multi layers. Because of this, for example, the insulated electric wire having a hexagonal cross section is known as described in Japanese Unexamined Patent Application, First Publication No. 2003-317547 (Patent Literature 1 (PTL 1)). When the cross section of the insulated electric wire is hexagonal, wires can be aligned for each side to be contacted. Thus, there is an advantage of reducing the voids in the wounded state. In addition, the insulated electric wires having the hexagonal cross section are described in Japanese Unexamined Patent Application, First Publication No. 2008-147062 (Patent Literature 2 (PTL 2)) and Japanese Unexamined Patent Application, First Publication No. 2009-134891 (Patent Literature 3 (PTL 3))

As a method for forming the insulating coating of the insulated electric wire, the immersing method, the application method, and the electrical deposition method are known. The immersing method and the application method are the methods, in which the conductive wire material (copper wire) to be the core material of the insulated electric wire is immersed in the coating material; or the coating material is applied on the surface of the wire material. Then, the coating material is dried, and then, baked to form the insulating coating on the surface of the wire material.

The electrodeposition method is a method in which the insulating coating is formed by electrodepositing a coating component on the surface of copper wire: by passing the copper wire to be the core material of the insulated electric wire through the electrodeposition solution including a coating component; and by applying electrical current on the copper wire. The electrodeposited coating component is subjected to a backing treatment to form the insulating coating. The insulated electric wires described in PTLs 1 and 2 are examples in which the insulating coating is formed by the application method. The insulated electric wire described in PTL 3 is an example in which the insulating coating is formed by the immersing method.

CITATION LIST

Patent Literature

PTL 1: Japanese Unexamined Patent Application, First Publication No. 2003-317547 (A)

PTL 2: Japanese Unexamined Patent Application, First Publication No. 2008-147062 (A)

PTL 3: Japanese Unexamined Patent Application, First Publication No. 2009-134891 (A)

SUMMARY OF INVENTION

Technical Problem

In general, the coating material adhered on the surface of the wire material tends to flow from the corner part to the flat part on the surface of the wire material during being dried in the immersing method and the application method. Thus, the coating tends to be thin on the corner part and the corner part tends to get rounder on the surface of the hexagonal wire material. When the above-described insulated electric wire is wound, voids are formed in the part where the corner parts of the insulated electric wire are abutted each other. Thus, there is a limitation on reducing the void ratio In the electrodeposition method, it is difficult for the coating component electrodeposited on the surface of the wire material to flow since the film density immediately after deposition is high. Thus, the method has an advantage that a sufficiently thick coating can be formed on the corner part. On the other hand, in the electrodeposition method, the electrolytic density becomes high on the part with a pointed shape; and the coating on the corner part becomes a swelled shape. Thus, the void 14 tends to be formed between the adjacent insulated electric wires 11 in the wound state as shown in FIG. 5. On the other hand, in the method, in which roundness is provided on the corner part in order to reduce the sharpness of the corner part of the hexagonal cross section, if the roundness were excessive, the void on the part in which the corner parts are abutted, would be large in the wound state as in the cases of the immersion method and the application method. Thus, it is impossible to reduce the void ratio.

In PTL 1, it is explained that the space factor in the wound state becomes nearly 100% on the insulated electric wire having a hexagonal cross section. However, in the case of the insulating coating formed by the electrodeposition method, the coating on the corner part becomes the swelled shape as explained above. Thus, it is difficult to obtain the space factor of nearly 100%. In PTL 1, the problem in coating formation by the electrodeposition is not recognized. Similarly, PTLs 2 and 3 are silent about the above-described technical problem.

By the present invention, the above-described technical problem in the insulated electric wire having a hexagonal cross section is solved. Regarding to the insulated electric wire on which an insulating coating is formed by the electrodeposition method, an insulated electric wire having an extremely low void ratio in the wounded state is provided, by forming the chamfered part, which has an appropriate length for suppressing swelling of the insulating coating on the corner part, on the corner part.

Solution to Problem

According to the present invention, as an aspect of the present invention, an insulated electric wire having configurations described below is provided.

(1) An insulated electric wire including: a copper wire; and an insulating coating formed on a surface of the copper wire by an electrodeposition method, wherein a cross section shape of the insulated electric wire including the insulating coating is in a hexagonal shape, a chamfered part that suppresses swelling of the insulating coating is formed on each corner part of a hexagonal cross section of the copper wire, a length of the chamfered part is ⅓ to 1/20 of a length of a flat part of the hexagonal cross section, and a void ratio in a wound state is 5% or less.

(2) The insulated electric wire according to the above-described (1), wherein a difference between: a thickness of the insulating coating on the flat part of the hexagonal cross section of the insulated electric wire; and a thickness of the insulating coating on the corner part of the insulated electric wire including the chamfered part, is 5 μm or less.

(3) The insulated electric wire according to the above-described (1) or (2), wherein a diameter of the hexagonal cross section of the copper wire converted to a circle having an identical cross sectional area to the hexagonal cross section of the copper wire is 0.5 mm to 5.0 mm, and a thickness of the insulating coating is 5 μm to 100 μm.

(4) A method of producing an insulated electric wire by an electrodeposition method, the method including the steps of:

electrodepositing a coating component on a surface of a copper wire to be a core material by the copper wire being passed through an electrodeposition bath filled with an electrodepositing solution including the coating component and by applying electrical current; and forming an insulating coating by performing a baking process on the coating component after the step of electrodepositing, wherein the cooper wire used in the step of electrodepositing a coating component has a hexagonal cross section, a chamfered part is formed on each corner part of the hexagonal cross section of the copper wire, and a length of the chamfered part is ⅓ to 1/20 of a length of a flat part of the hexagonal cross section, a difference between: a thickness of the insulating coating on the flat part of the hexagonal cross section of the insulated electric wire; and a thickness of the insulating coating on the corner part of the insulated electric wire including the chamfered part, is 5 μm or less, and an insulated electric wire having a void ratio in a wound state is 5% or less is produced.

(5) The method of producing an insulated electric wire according to the above-described (4), wherein the copper wire used in the step of electrodepositing a coating component has a diameter of the hexagonal cross section of the copper wire converted to a circle having an identical cross sectional area to the hexagonal cross section of the copper wire is 0.5 mm to 5.0 mm, and the insulating coating formed on the surface of the copper wire in the step of forming an insulating coating has a thickness of 5 to 100 μm.

(Specific Explanation)

The first aspect of the present invention is an insulated electric wire (hereinafter, referred as "the insulated electric wire of the present invention") including: a copper wire; and an insulating coating formed on a surface of the copper wire by an electrodeposition method, wherein a cross section shape of the insulated electric wire including the insulating coating is in a hexagonal shape, a chamfered part that suppresses swelling of the insulating coating is formed on each corner part of a hexagonal cross section of the copper wire, a length of the chamfered part is ⅓ to 1/20 of a length of a flat part of the hexagonal cross section, and a void ratio in a wound state is 5% or less.

The cross section shape of the insulated electric wire of the present invention is shown in FIG. 1. As shown in FIG. 1, in the insulated electric wire 10 of the present invention, the copper wire 11 of the core material has the hexagonal cross section in the cross section perpendicular to the axis direction of the insulated electric wire. It is preferable that the hexagonal cross section is the cross section in the regular hexagon. However, it is not limited to the regular hexagon in the present invention. Thus, it may be acceptable that the cross section is formed by six sides; and is a hexagon capable of being aligned with each side contacting to a side of the adjacent hexagon when the shapes are aligned in a plane. Thus, it includes an entirely elongated hexagon.

The copper wire 11 having the hexagonal cross section can be manufacture by a method using a pressure roll or the like. For example, the copper wire 11 can be manufacture by: forming the intermediate copper wire having a roughly hexagonal cross section by pressing a round copper wire while pressing it from 3 directions with pressing rolls having V-shaped grooves; and then performing drawing using a die having the dice hole shape. The dice hole shape has a hexagonal cross section; the is formed on each corner of the hexagonal cross section; and the length of the chamfered corner forming part is ⅓ to 1/20 of a length of each side of the hexagonal cross section (in other words, the length of the flat part). By changing the size of the chamfered corner forming part of the dice hole, the length of the chamfered part is formed so that it is adjusted to be ⅓ to 1/20 of the length of the flat part of the hexagonal cross section in the hexagonal cross section of the copper wire.

The insulating coating 12 covering the surface of the copper wire 11 is provided. The insulating coating 12 is formed by the electrodeposition method. The electrodeposition method is a method, in which the insulating coating 12 is formed by electrodepositing the coating component on the surface of the copper wire by passing the copper wire 11 to be the core material through the electrodeposition solution including a coating component; and by applying electrical current on the copper wire. Then, the electrodeposited coating component is subjected to a backing treatment to form the insulating coating 12.

On each corner part of the hexagonal cross section of the copper wire 11, the chamfered part 13 suppressing swelling of the coating on the corner part is formed. The shape of the chamfered part 13 in the hexagonal cross section may be in a straight line shape or in a curved shape. The length R of the chamfered part 13 is set to ⅓ to 1/20 of the length L of the flat part of each side of the hexagonal cross section. Preferably, the length R of the chamfered part 13 is set to ⅓ to 1/10 of the length L of the flat part of each side.

The length R of the chamfered part 13 is the shortest length from one end "a" to another end "b" of the chamfered part 13. As shown in FIG. 2, for example, in the case where the chamfered part 13 is in the shape of the straight line, the length R is the length of the straight line from the one end "a" to the other end "b"; and in the case where the chamfered part 13 in the curved shape, the length R is the length of the straight line connecting the one end "a" and the other end "b." The length L of the flat part of each sides of the hexagon is the length of the flat part sandwiched by the adjacent corners in the hexagonal cross section.

In the insulated electric wire 10 of the present invention, the chamfered part 13 is formed in such a way that the length R of the chamfered part 13 is in the above-described range relative to the length L of the flat part of each side of the hexagonal cross section. Thus, thickening of the coating on the corner part is suppressed in forming the insulating coating 12 by the electrodeposition method; and the difference of the coating thickness on the flat part on the surface and the corner part of the conducting wire can be reduced. Specifically, the difference of the insulating coating thickness on the flat part and the corner part can be set to 5 μm or less, preferably to 3 μm or less. The difference D of the insulating coatings on the flat part and the corner part is the difference between the minimum thickness Ds of the insulating coating on the flat part and the maximum thickness Dm of the insulating coating on the corner part (D=Dm−Ds).

Because of this, there is almost no void formed between the adjacent insulated electric wires 10 when the insulated electric wire 10 is wound. Thus, the void ratio in the wound state is reduced. Specifically, in the insulated electric wire 10 of the present invention, the void ratio in the wound state is set to 5% or less, preferably to 2% or less.

The void ratio in the wound state means the percentage ratio (%) of the total void area "s" formed between the insulated electric wire adjacent each other to the entire cross sectional area "S" surrounded by the outline shape of the insulated electric wire 10 including the insulating coating, which is expressed by the formula, the void ratio=s/S×100, in the state where multiple insulated electric wires 10 are bundled with the adjacent sides thereof being contacted tightly. Specifically, for example, it is the ratio of the total void area "s" formed in the abutted parts of each of the sides A, B, and C of the hexagonal cross section of the insulated electric wire 10 to the area surrounded by the entire outline shape including the insulating coating of the insulated electric wire 10 in the cross sectional view in FIG. 3. The void ratio can be obtained from the cross section photograph after winding the insulated electric wire 10 in a coil shape.

In the insulated electric wire 10 of the present invention, the void ratio in the wound state is 5% or less, preferably 2% or less. In the conventional insulated electric wires having no chamfered part provided in the insulated electric wire 10 of the present invention, when the insulating coating is formed by the electrodeposition method, the insulating coating on the corner part is formed thickly since the electrolytic density becomes high in the vicinity of the corner part. Thus, voids tend to be formed on the flat part when the insulating electric wire is wound. In the conventional insulated electric wires in which the insulating coating is formed by the electrodeposition method, the void ratio is roughly 7 to 12%. On the other hand, in the insulated electric wire of the present invention, the void ratio is significantly lower than the void ratio of the conventional insulated electric wires.

The insulated electric wire of the present invention has a hexagonal cross section; and there is high degree of freedom in winding since it is easy to be wound in the six directions along with each of sides of the hexagonal cross section. On the other hand, the cross section of the flat insulated electric wire is in a rectangular shape, for example. Thus, winding direction is limited to the winding along the long side (flat-wise winding) or the short side (edge-wise winding); it is hard to be wound in other direction; and degree of freedom in winding is low.

In the insulated electric wire of the present invention, it is preferable that the diameter of the copper wire 11 is set in such a way that the diameter of the hexagonal cross section of the copper wire 11 converted to the circle having the identical cross sectional area to the hexagonal cross section of the copper wire is 0.5 mm to 5.0 mm. In addition, it is preferable that the thickness of the coating is in the range of 5 μm to 100 μm, more preferably 10 μm to 90 μm. Insulated electric wires having such a diameter and a coating thickness are widely used as the magnetic wire of the drive motor for automobiles; the magnetic wire of the alternator; the magnetic wire for the starter motor; and the magnetic wire for the reactor, for example. The insulated electric wire of the present invention having the above-described diameter and the coating thickness is ideal for the uses described above.

Advantageous Effects of Invention

The insulated electric wire of the present invention has the hexagonal cross section and the chamfered part on each of corner parts of the hexagon. Thus, thicknesses of the insulating coating on the corner parts do not become extremely thick when the insulating coating is formed by the electrodeposition method. Thus, there is almost no void formed in winding the insulated electric wire; and the void ratio can be set to an extremely low value. In addition, the insulated electric wire of the present invention has the chamfered part on the corner part in the hexagonal cross section, it is hard to cause damage of the insulating coating due to abrasion between the adjacent insulated electric wires in being wound. Thus, the insulation reliability of the corner part is high.

Furthermore, in the insulted electric wire of the present invention, the winding direction can be changed easily during winding since it can be easily wound in 6 directions along with the each of sides of the hexagonal cross section. Conventionally, it has been difficult to continuously wind the flat insulated electric wire on a stator; and the flat insulated electric wire cut into the length of the stator is inserted into the stator slot for the ends thereof to be welded. Contrary to that, in the insulated electric wire of the present invention, it can be wound continuously on the stator. Thus, winding operation can be simplified. Moreover, since the void ratio is low, a high performance motor can be manufactured at low cost.

(Production Method)

First, the copper wire 11 having the hexagonal cross section can be manufacture by a method using a pressure roll or the like. In the present embodiment, the intermediate copper wire having a roughly hexagonal cross section is formed by pressing a round copper wire while pressing it from 3 directions with pressing rolls having V-shaped grooves. Then, the copper wire 11 is produced by performing drawing using a die having the dice hole shape. The dice hole shape has a hexagonal cross section; the chamfered corner forming part is formed on each corner of the hexagonal cross section; and the length of the chamfered corner forming part is ⅓ to 1/20 of the length the flat part of each side of the hexagonal cross section.

Next, the copper wire to be the core material is passed through the electrodeposition bath filled with the electrodepositing solution including the coating component and the electrical current is applied for the coating composition to be electrodeposited on the surface of the copper wire. Then, the insulating coating is formed by performing the baking treatment on the coating composition. Because of this, the insulated electric wire having the hexagonal cross section and the chamfered part being formed on each of the corners of the hexagonal cross section is produced.

As the electrodeposition solution, any one of the anion type and the cation type can be used. As the resin component included in the electrodeposition solution, the polyimide resin, the polyamide imide resin, the polyester imide resin, the acrylic resin, the epoxy resin, the epoxy-acrylic resin, the polyurethane resin, the polyester resin, and the like can be named, for example.

In the above-described production method, it is preferable that the copper wire, which has the diameter of the hexagonal cross section of the copper wire converted to the circle having the identical cross sectional area to the hexagonal cross section of the copper wire is 0.5 mm to 5.0 mm, is used; and the insulating coating formed on the surface of the copper wire has the thickness of 5 μm to 100 μm. The insulated electric wire as configured as described above can be widely used as: the magnetic wire of the drive motor for automobiles; the magnetic wire of the alternator; the magnetic wire for the starter motor; and the magnetic wire for the reactor.

DESCRIPTION OF EMBODIMENTS

Example 1

Figure 1:
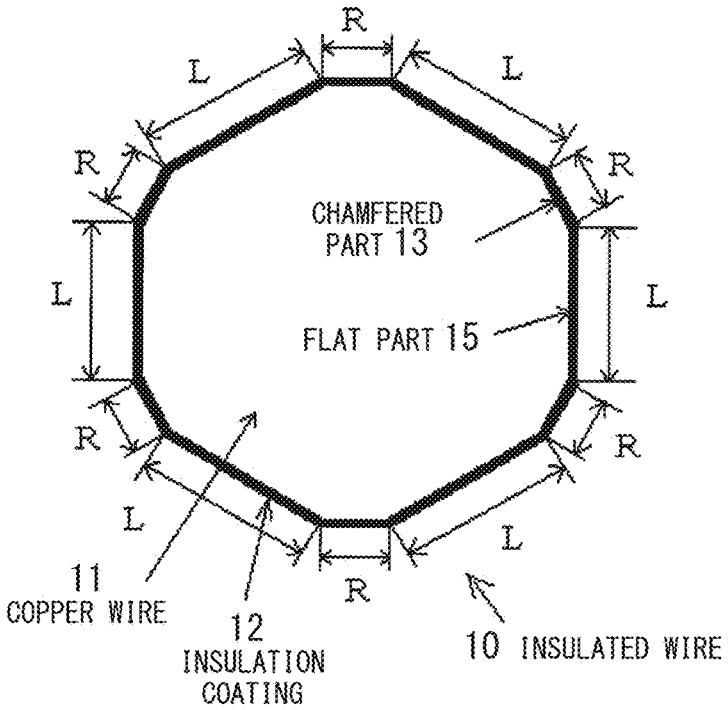
FIG. 1 is a schematic cross sectional view of the insulated electric wire of the present invention.
Figure 2:
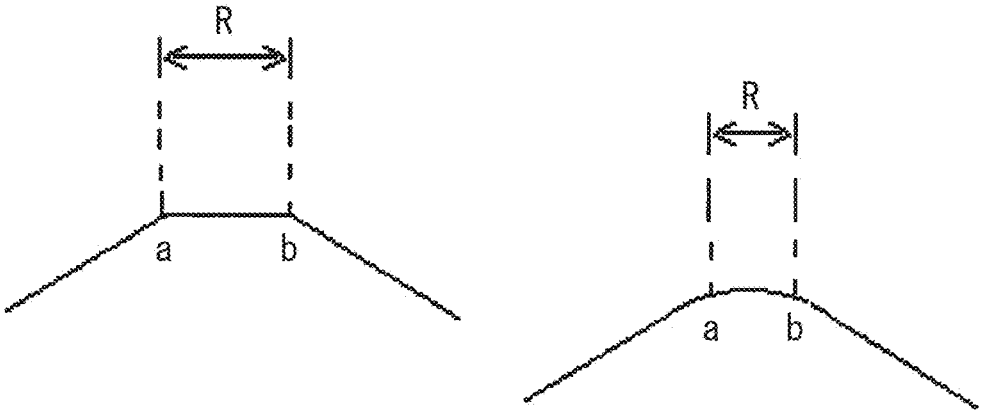
FIG. 2 is a partial schematic sectional view of the chamfered part of the insulated electric wire of the present invention.
Figure 3:
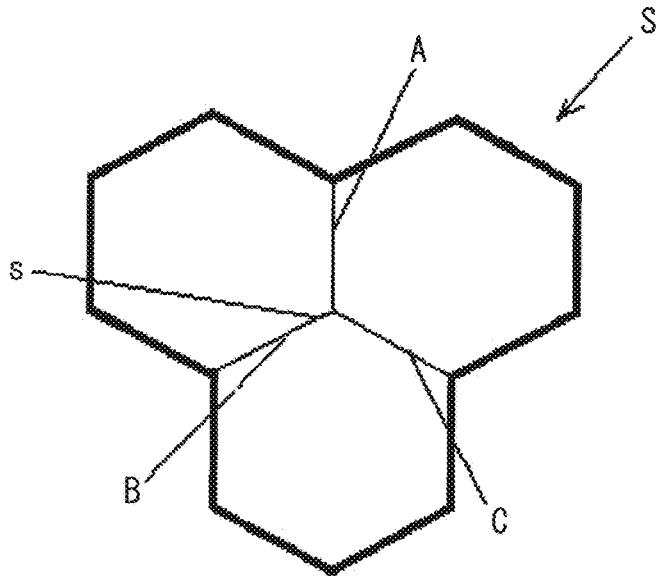
FIG. 3 is a schematic cross sectional view showing the wound state of the insulated electric wire of the present invention.
Figure 4:
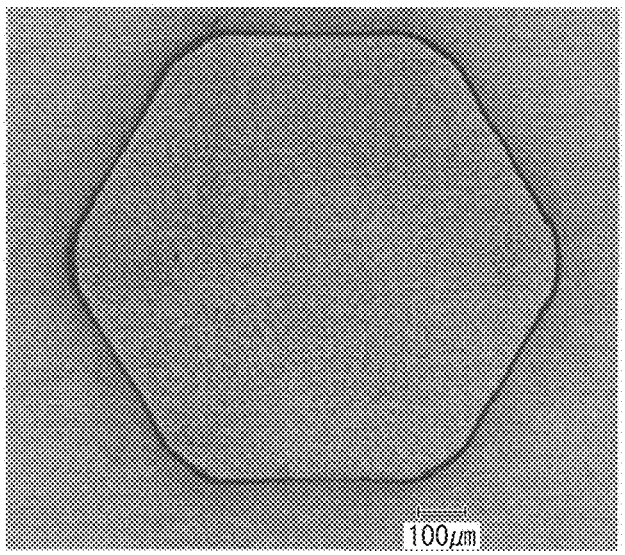
FIG. 4 is an enlarged cross sectional photograph of the insulated electric wire B of Example 1.
Figure 5:
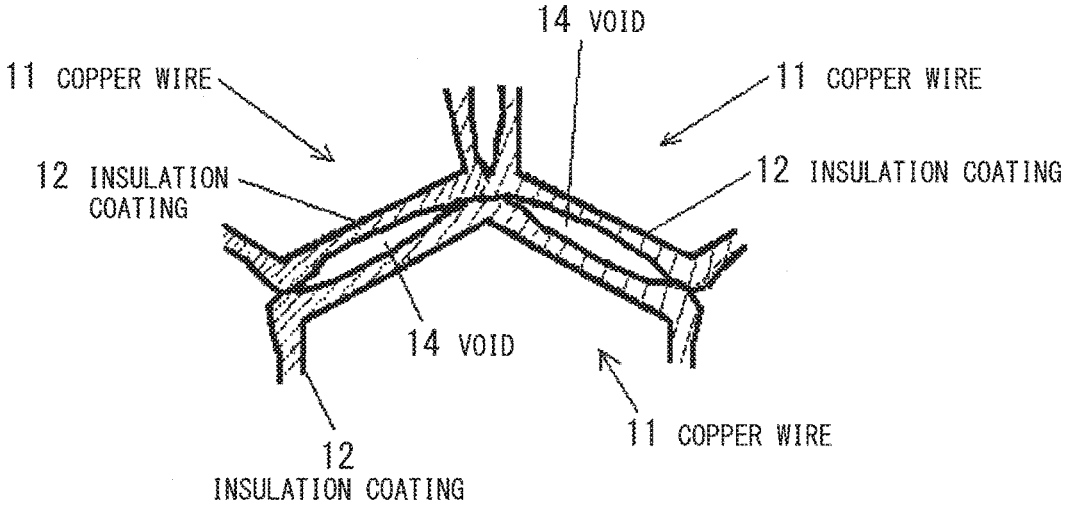
FIG. 5 PRIOR ART
FIG. 5 is a schematic cross sectional view showing the wound part of the conventional insulated electric wire formed by the electrodeposition method.

After preparing the intermediate copper wire by using a round copper hard wire having 1.1 mm of the outer diameter φ with pressure rollers, the hexagonal cross section, which had 0.3 mm of the flat part length of each side; and 0.1 mm of the chamfered part length, was formed by drawing it through the finish die. The copper wire with the hexagonal cross section was passed through the electrodeposition bath filled with the electrodeposition solution including polyimide, which was the resin component of the coating; and the resin coating was attached on the surface of the copper wire by applying electrical current using the copper wire as the anode. By varying the electrical current density, two kinds of resin coatings with the layer thicknesses of 5 μm and 10 μm were formed. The insulated electric wire A, the minimum thickness of the coating of the flat part was 5 μm, and the insulated electric wire B, the minimum thickness of the coating of the flat part was 10 μm, were produced by inserting them in a furnace for drying; and by performing the baking treatment in the furnace with the setting of 200° C. to 500° C. of the temperature gradient. On these insulated electric wires A and B, the differences D between the minimum thickness Ds of the insulating coating on the flat part and the maximum thickness Dm of the insulating coating on the corner part; and the void ratios in the wound state are shown in Table 1. The cross sectional photograph of the insulated electric wire B is shown in FIG. 4.

Example 2

The insulated electric wires C to J were produced: by using the copper wires processed in such a way that the length L of the flat part of the hexagonal cross section and the length R of the chamfered part are set as shown in Table 1; and by forming the insulating coatings by the electrodeposition method as in Example 1. On these insulated electric wires C to J, the differences D between the minimum thickness Ds of the insulating coating on the flat part and the maximum thickness Dm of the insulating coating on the corner part; and the void ratios in the wound state are shown in Table 1.

Comparative Example 1

A round copper hard wire having 0.1 mm of the outer diameter φ was passed through pressure rollers; and processed by drawing through a finish die.

At this time, the chamfered part was not provided to the finish die, and the copper wire was processed into a hexagonal cross section. The insulated electric wire X was produced by using this copper wire having the hexagonal cross section and by the electrodeposition method as the insulated electric wire B in Example 1. Results are shown in Table 1.

Comparative Example 2

The insulated electric wire Y was produced by using the round copper hard wire having 1.0 mm of the outer diameter φ as it is with the round cross section without being processed into the hexagonal cross section and by the electrodeposition method as in the insulated electric wire B in Example 1 except for the above-described difference. Results are shown in Table 1.

Comparative Example 3

Round copper hard wires having 3.0 mm and 5.0 mm of the outer diameters φ, were passed through pressure rollers; and processed by drawing through a finish die. At this time, the chamfered part was not provided to the finish die, and the copper wires were processed into a hexagonal cross section. The insulated electric wires Z1 and Z2 were produced by using the above-described cooper wires and by forming the insulating coatings by the electrodeposition method as in Example 1. Results are shown in Table 1.

Comparative Example 4

A round copper hard wire having 3.0 mm of the outer diameter φ was passed through pressure rollers; and processed by drawing through a finish die in such a way that the ratio R/L became ½ or 1/30. The insulated electric wires Z3 and Z4 were produced by using the above-described copper wires and by forming the insulating coatings by the electrodeposition method as in Example 1. Results are shown in Table 1.

As shown in Table 1, the void ratios were 5% or less in any one of the insulted electric wires A to J of the present invention; and the void ratios in the wound state were extremely low by proving the chamfered part on the corner part. On the other hand, in any one of the insulated electric wires X, Z1 and Z2, which were not provided with the chamfered part; and the insulated electric wire Y in the round cross section, the void ratios in the wound state were high and 7% to 12%. In addition, in the insulated electric wires Z3 and Z4 in which the ratios of the length R of the chamfered part and the length L of the flat part were set differently from the scope of the present invention, the void ratios in wound state were high, and 7% and 8%, respectively.

TABLE 1

| | | Diameter converted to the round wire (mm Φ) | R/L ratio of the hexagonal cross section | The minimum thickness of the coating Ds on the flat part (μm) | The maximum thickness of the coating Dm on the corner part (μm) | Difference of the thicknesses D (μm) | Void ratio |
|---|---|---|---|---|---|---|---|
| Example of the present invention | Insulated electric wire A | 1.0 | 1/3 | 5 | 6 | 1 | 2% |
| | Insulated electric wire B | 1.0 | 1/3 | 10 | 12 | 2 | 2% |
| | Insulated electric wire C | 1.0 | 1/10 | 10 | 12 | 2 | 3% |
| | Insulated electric wire D | 1.0 | 1/20 | 10 | 12 | 2 | 4% |
| | Insulated electric wire E | 3.0 | 1/3 | 40 | 42 | 2 | 3% |
| | Insulated electric wire F | 3.0 | 1/10 | 40 | 43 | 3 | 2% |
| | Insulated electric wire G | 3.0 | 1/20 | 40 | 43 | 3 | 4% |
| | Insulated electric wire H | 5.0 | 1/3 | 100 | 104 | 4 | 4% |
| | Insulated electric wire I | 5.0 | 1/10 | 100 | 105 | 5 | 4% |
| | Insulated electric wire J | 5.0 | 1/20 | 100 | 105 | 5 | 5% |
| Comparative Example | Insulated electric wire X | 1.0 | (No chamfered part) | 10 | 18 | 8 | 7% |
| | Insulated electric wire Y | 1.0 | (Round cross section) | 10 | — | — | 9% |
| | Insulated electric wire Z1 | 3.0 | (No chamfered part) | 40 | 55 | 15 | 9% |
| | Insulated electric wire Z2 | 5.0 | (No chamfered part) | 100 | 126 | 26 | 12% |
| | Insulated electric wire Z3 | 3.0 | 1/2 | 40 | 42 | 2 | 7% |
| | Insulated electric wire Z4 | 3.0 | 1/30 | 40 | 48 | 8 | 8% |

Note:
R/L ratio is the ratio of the length R of the chamfered part to the length L of the flat part.
D is the difference between the minimum thickness Ds of the insulating coating on the flat part and the maximum thickness Dm of the insulating coating on the corner part.

INDUSTRIAL APPLICABILITY

An insulated electric wire, which has high degree of freedom in the winding direction and an extremely low void ratio in the wound state, is provided. The insulated electric wire can be utilized more suitably as a wire material for coils such as motors and the like.

REFERENCE SIGNS LIST

10: Insulated electric wire

11: Wire

12: Insulating coating

13: Chamfered part

14: Void

L: Length of the flat part on each side of the hexagonal shape

R: Length of the chamfered part a, b: End s: Surface of the entire void formed on the abutted parts of each of the sides A, B, and C of the hexagonal cross section S: Area surrounded by the entire outline shape including the insulating coating

What is claimed is:

1. An insulated electric wire comprising: a copper wire; and an insulating coating formed on a surface of the copper wire by an electrodeposition method, wherein a cross section shape of the insulated electric wire including the insulating coating is in a hexagonal shape, a chamfered part that suppresses swelling of the insulating coating is formed on each corner part of a hexagonal cross section of the copper wire, a length of the chamfered part is ⅓ to 1/20 of a length of a flat part of the hexagonal cross section, and a void ratio in a wound state is 5% or less.

2. The insulated electric wire according to claim 1, wherein a difference between: a thickness of the insulating coating on the flat part of the hexagonal cross section of the insulated electric wire; and a thickness of the insulating coating on the corner part of the insulated electric wire including the chamfered part, is 5 μm or less.

3. The insulated electric wire according to claim 1, wherein a diameter of the hexagonal cross section of the copper wire converted to a circle having an identical cross sectional area to the hexagonal cross section of the copper wire is 0.5 mm to 5.0 mm, and a thickness of the insulating coating is 5 μm to 100 μm.

4. A method of producing an insulated electric wire by an electrodeposition method, the method comprising the steps of:

electrodepositing a coating component on a surface of a copper wire to be a core material by the copper wire being passed through an electrodeposition bath filled with an electrodepositing solution including the coating component and by applying electrical current; and forming an insulating coating by performing a baking process on the coating component after the step of electrodepositing, wherein the cooper wire used in the step of electrodepositing a coating component has a hexagonal cross section, a chamfered part is formed on each corner part of the hexagonal cross section of the copper wire, and a length of the chamfered part is ⅓ to 1/20 of a length of a flat part of the hexagonal cross section, a difference between: a thickness of the insulating coating on the flat part of the hexagonal cross section of the insulated electric wire; and a thickness of the insulating coating on the corner part of the insulated electric wire including the chamfered part, is 5 μm or less, and an insulated electric wire having a void ratio in a wound state is 5% or less is produced.

5. The method of producing an insulated electric wire according to claim 4, wherein the copper wire used in the step of electrodepositing a coating component has a diameter of the hexagonal cross section of the copper wire converted to a circle having an identical cross sectional area to the hexagonal cross section of the copper wire is 0.5 mm to 5.0 mm, and the insulating coating formed on the surface of the copper wire in the step of forming an insulating coating has a thickness of 5 to 100 μm.

6. The insulated electric wire according to claim 2, wherein a diameter of the hexagonal cross section of the copper wire converted to a circle having an identical cross sectional area to the hexagonal cross section of the copper wire is 0.5 mm to 5.0 mm, and a thickness of the insulating coating is 5 μm to 100 μm.

* * * * *